US011913210B2

(12) United States Patent
Wanderi

(10) Patent No.: US 11,913,210 B2
(45) Date of Patent: Feb. 27, 2024

(54) RETROFIT SYSTEM FOR SELF-CLEANING TOILET WASHING MACHINE AND TOILET INCORPORATING SAME

(71) Applicant: Samuel Mwangi Wanderi, Hilliard, OH (US)

(72) Inventor: Samuel Mwangi Wanderi, Hilliard, OH (US)

( * ) Notice: Subject to any disclaimer, the term of this patent is extended or adjusted under 35 U.S.C. 154(b) by 22 days.

(21) Appl. No.: 17/587,974

(22) Filed: Jan. 28, 2022

(65) Prior Publication Data

US 2022/0243442 A1 Aug. 4, 2022

Related U.S. Application Data

(60) Provisional application No. 63/143,837, filed on Jan. 30, 2021.

(51) Int. Cl.
*E03D 9/00* (2006.01)

(52) U.S. Cl.
CPC ..... *E03D 9/005* (2013.01)

(58) Field of Classification Search
CPC ..... E03D 9/002; E03D 9/005; E03D 2201/40; A47K 13/302
See application file for complete search history.

(56) References Cited

U.S. PATENT DOCUMENTS

| | | | | |
|---|---|---|---|---|
| 4,183,105 | A | 1/1980 | Womack | |
| 4,242,765 | A * | 1/1981 | Russell | E03D 5/00 4/321 |
| 5,022,098 | A * | 6/1991 | Brower | E03D 9/005 4/233 |
| 6,003,159 | A * | 12/1999 | Sadegh | A47K 13/302 4/233 |
| 2010/0257662 | A1 | 10/2010 | Huang | |

FOREIGN PATENT DOCUMENTS

| | | | |
|---|---|---|---|
| CN | 108842886 | A * | 11/2018 |
| FR | 2621631 | A1 | 4/1989 |
| WO | 2011092877 | A1 | 8/2011 |
| WO | 2018156190 | A1 | 8/2018 |

* cited by examiner

*Primary Examiner* — Erin Deery
(74) *Attorney, Agent, or Firm* — Ice Miller LLP

(57) ABSTRACT

The present invention generally relates to a toilet seat and toilet cover assembly, as well as a toilet fitted therewith. The assembly generally includes seals that seal the toilet seat and both the toilet cover and toilet bowl when in the closed position; a water conduit for a source of pressurized water; a spray assembly mounted on the assembly comprising: a sprayer conduit accepting a supply of pressurized water from the water conduit; and a sprayer array connected to the sprayer conduit and disposed on the toilet seat and toilet cover assembly, and adapted to direct a spray of pressurized water across an interior bowl surface of a toilet bowl once in the closed position; and at least one valve to control the supply of water to the sprayer conduit. The present invention may also include a detergent injector to inject a cleaning agent into the water supply.

10 Claims, 8 Drawing Sheets

RETROFIT SYSTEM FOR SELF-CLEANING TOILET WASHING MACHINE AND TOILET INCORPORATING SAME

CROSS-REFERENCE TO RELATED APPLICATIONS

This Application claims priority to U.S. Provisional Patent Application Ser. No. 63/143,837, filed Jan. 30, 2021, which is hereby incorporated herein by reference in its entirety.

BACKGROUND OF THE INVENTION

Today we have dishwashers, washing machines, self-propelled vacuum cleaners and the like to help us with our repetitive tedious routine cleaning chores. All of these devices share a common trait necessary to make them effective at cleaning which is they all utilize moving parts or high-pressure liquid jets moving along surfaces to clean them. Additionally, they leverage gaskets and tightly fitted parts to contain water and liquids in appropriate places. However, they all share a common shortcoming in their reliance on batteries or electricity. This dependency on electricity creates a problem in locations where electrical outlets are scarce or dangerous to operate like in the bathroom near the toilet. For this reason, we have developed a toilet washing machine that leverages the utility of moving parts necessary to clean surfaces effectively but not dependent on electricity or batteries for power. These two innovations combined with others discussed and applied to the toilet, create the Smart Cleaning Toilet Washing Machine (Machine).

The Machine cleans all parts of the toilet including the cover, seat, and bowl without the use of electricity. The Machine has a universal fit for most standard residential-style toilets avoiding electrical modification of the bathroom. The Machines install complexity is a level similar to that of changing out a toilet seat, such as may be applied in some embodiments of the present invention for retrofitting an existing toilet. The Machine has a high degree of ease of use due to one touch operation and automatic shut off when conditions dictate.

SUMMARY OF THE INVENTION

The present invention generally includes a toilet seat and toilet cover assembly for a self-cleaning toilet comprising: (a) a toilet seat and toilet cover assembly comprising a toilet seat and a toilet cover and a hinge connection assembly adapted to connect the toilet seat and toilet cover assembly over a toilet bowl, whereby both toilet seat and toilet cover are adapted to be moved from an open position to a closed position, and the toilet seat and toilet cover provided with a seal between the toilet seat and toilet cover when in the closed position, and wherein the hinge connection assembly is adapted to connect the toilet seat and toilet cover assembly over a toilet bowl; (b) a water conduit for the supply of water from a source of pressurized water; (c) a spray assembly mounted on the toilet seat and toilet cover assembly and comprising: (i) a sprayer conduit adapted to accept a supply of pressurized water from the water conduit; and (ii) a sprayer array connected to the sprayer conduit and disposed on the toilet seat and toilet cover assembly, and adapted to direct a spray of pressurized water across an interior bowl surface of a toilet bowl once the toilet seat and toilet cover assembly are connected over a toilet bowl; and (d) at least one valve to control the supply of water to the sprayer conduit.

In some embodiments, the sprayer assembly may comprise a hydraulically-driven oscillating sprayer or other functionally equivalent mechanism for changing the spray direction during a cleaning cycle. In other embodiments, the sprayer assembly may be disposed on the toilet seat portion or incorporated into the toilet seat portion though use of open compartments or channels in or along the inner circumference thereof.

In alternative embodiments, the sprayer assembly may comprise a mechanical arrangement driven by pressurized water from the sprayer conduit and adapted to change the direction of the spray of pressurized water across the interior bowl surface and against the toilet seat and toilet cover assembly.

The time control valve may in some embodiments comprise a hydraulically-driven timer assembly, or an equivalent electric, spring, or battery timer may be used.

In other embodiments, the valve(s) may include an optional shut off valve adapted to interrupt the supply of water to the sprayer conduit when the toilet seat or toilet cover are moved to an open position.

In still other embodiments the toilet seat portion may comprise a housing and the sprayer assembly is disposed within the housing.

In yet other embodiments the sprayer assembly may comprise at least two spray heads adapted to deliver respectively different spray profiles to direct spray against the desired portion(s) of the toilet bowl surface and/or provide for a moving spray pattern to efficiently direct spray against certain regions of the toilet bowl interior surfaces (once closed), including without limitation, the toilet bowl, seat top, bottom and/or other interior surfaces and toilet cover underside surfaces.

The present invention further generally includes a self-cleaning toilet created through the incorporation of a toilet seat and toilet cover assembly of the present invention, and comprising: (a) a toilet comprising: (i) a toilet bowl comprising an interior bowl surface; (ii) a toilet seat and toilet cover assembly comprising a toilet seat and a toilet cover, both adapted to be moved from an open position to a closed position, and the toilet seat and toilet cover provided with seals so as to seal the toilet bowl when in the closed position; and (iii) a water conduit for the supply of water from a source of pressurized water; and (iv) a water tank adapted to accept a supply of pressurized water from the water conduit; and (b) a spray assembly comprising: (i) a sprayer conduit adapted to accept a supply of pressurized water from the water conduit; and (ii) a sprayer assembly connected to the sprayer conduit and disposed within the toilet bowl and beneath the toilet seat and toilet cover assembly when in the closed position, and adapted to direct a spray of pressurized water across the interior bowl surface; and (c) at least one valve to control the supply of water to the sprayer conduit.

In some embodiments, the sprayer assembly is adapted to direct a spray of water across the interior bowl surface and against the toilet seat and toilet cover assembly.

In other embodiments, the sprayer assembly may comprise a mechanical arrangement driven by pressurized water from the sprayer conduit and adapted to change the direction of the spray of water across the interior bowl surface.

In still other embodiments, the sprayer assembly may comprise a hydraulically-driven oscillating sprayer.

The spray assembly may be mounted anywhere on the toilet seat and cover assembly such as being disposed on the toilet seat portion.

In other embodiments, the sprayer assembly may comprise a mechanical arrangement driven by pressurized water from the sprayer conduit and adapted to change the direction of the spray of pressurized water across the interior bowl surface and against the toilet seat and toilet cover assembly, such as through the incorporation of a hydraulically-driven oscillating sprayer.

The valve(s) may comprise a time control valve adapted to control the duration of time during which a supply of water is supplied to the sprayer conduit; and this may be in some embodiments an electronic or spring driven timer device.

The valve(s) may also comprise a shut off valve adapted to interrupt the supply of water to the sprayer conduit when the toilet seat or toilet cover are moved to an open position.

In yet other embodiments, the toilet cover may comprise a transparent portion.

The invention may be constructed as a retrofit system whereby the toilet seat and toilet cover assembly is used to replace a standard toilet seat and toilet cover of an existing toilet to create a self-cleaning toilet.

DETAILED DESCRIPTION

Figure 1:
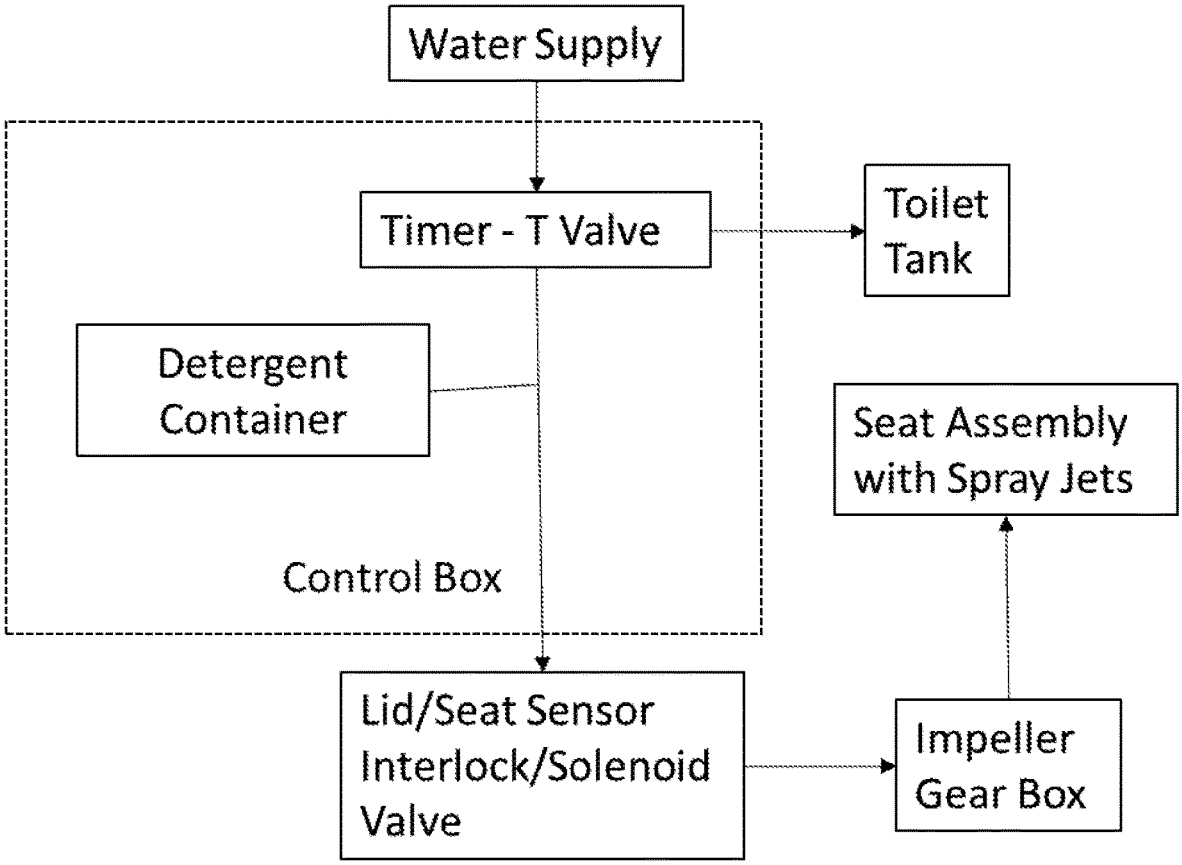
FIG. 1 is a schematic flow diagram of a cleaning system for a toilet assembly according to an embodiment of the invention.
Figure 2:
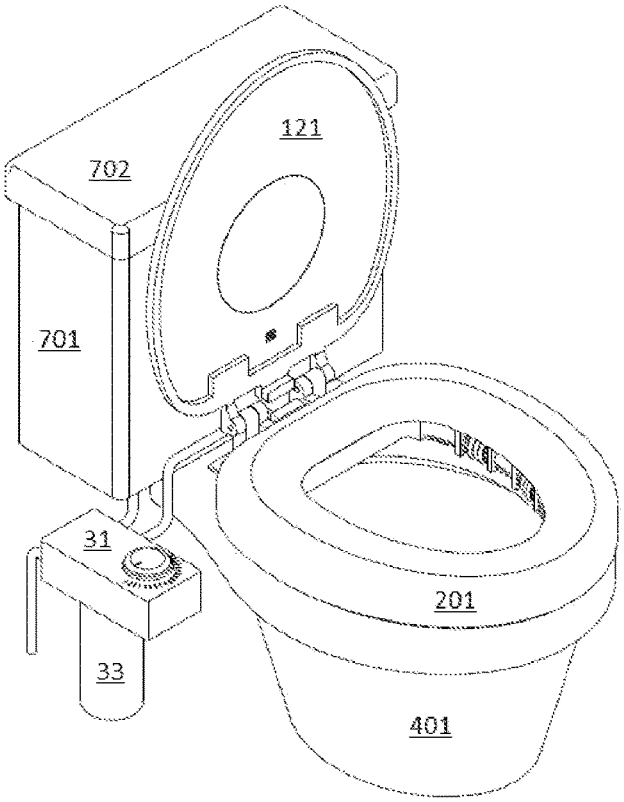
FIG. 2 is a perspective view of the toilet tank, cover, seat, bowl, and control systems used for cleaning system according to an embodiment of the invention and as part of a toilet assembly herein.
Figure 3A:
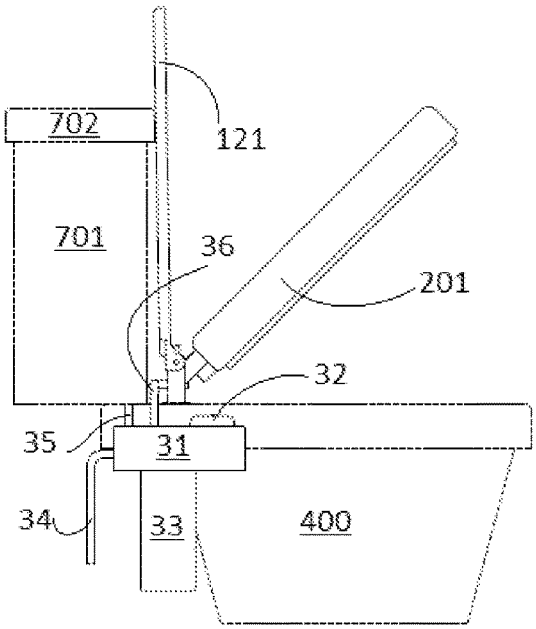
FIG. 3A is a side perspective view of a cleaning system tank, cover, seat, bowl, and control assemblies with the seat and cover open according to an embodiment of the invention.
Figure 3B:
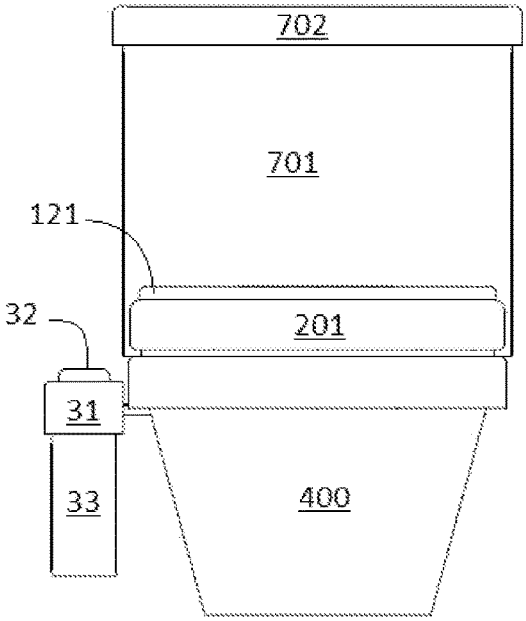
FIG. 3B is a front perspective view of the cleaning system tank, cover, seat, bowl, and control assemblies of FIG. 3A with the cover and seat closed, according to an embodiment of the invention.
Figure 4:
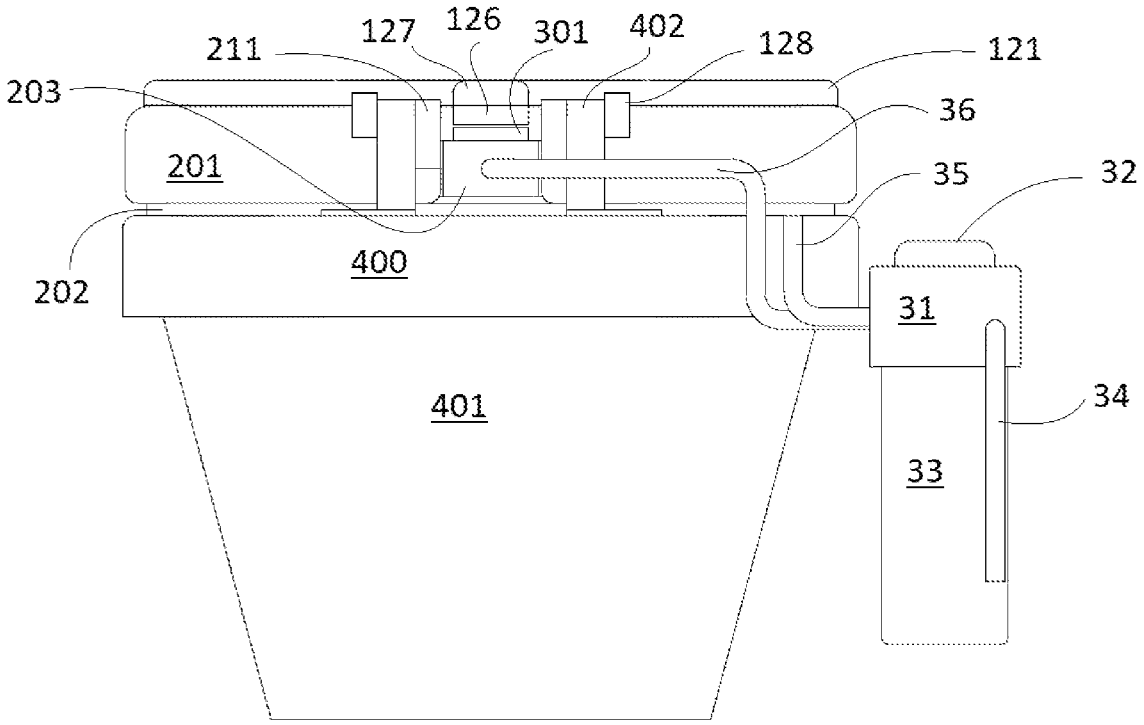
FIG. 4 is a rear perspective view of the cleaning system, cover, seat, bowl, and control assemblies of FIG. 3A with the cover and seat closed, according to an embodiment of the invention.
Figure 5:
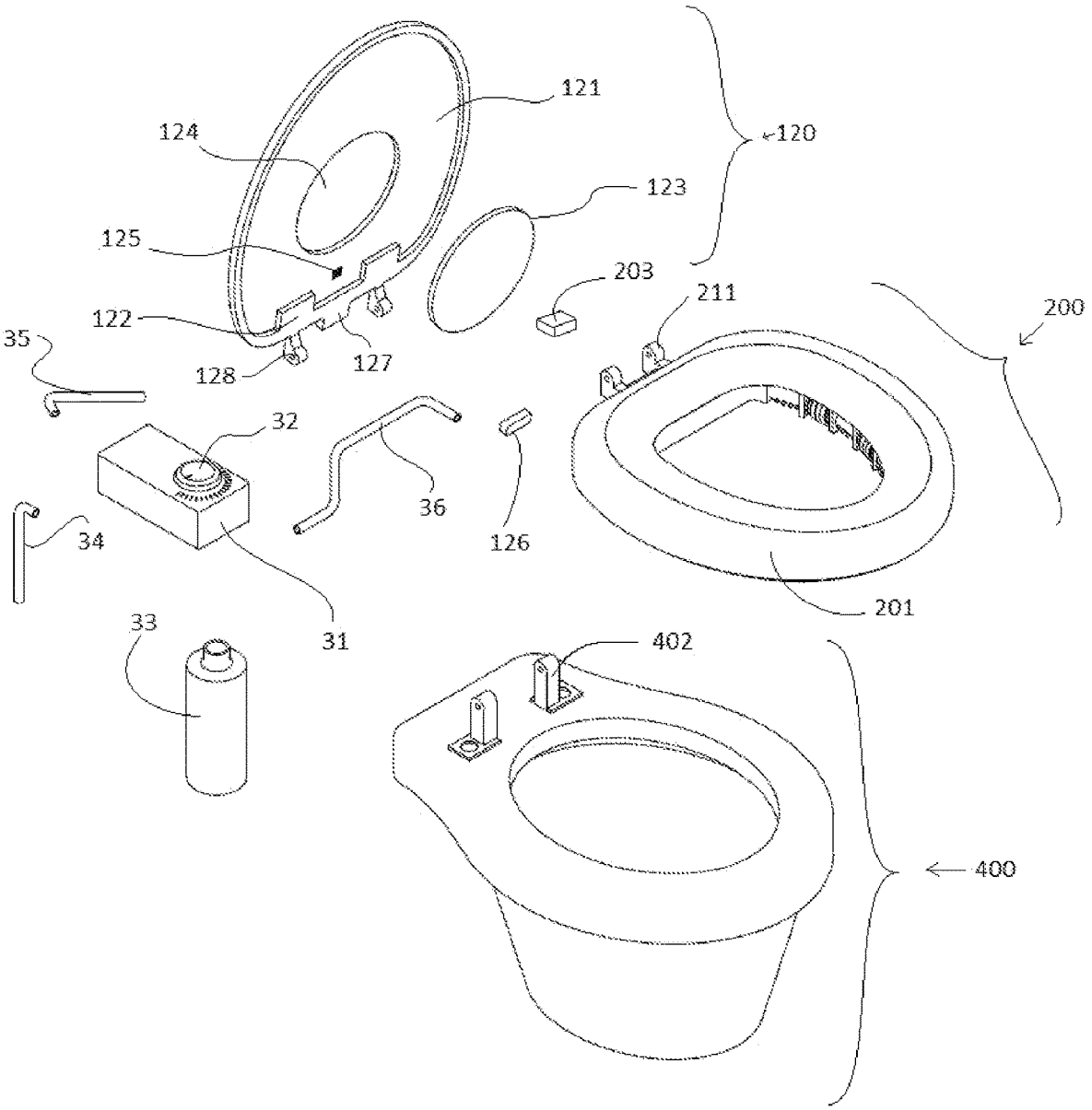
FIG. 5 is an exploded view of the embodiment of the cleaning system cover, seat and bowl assemblies according to FIG. 3A.
Figure 6:
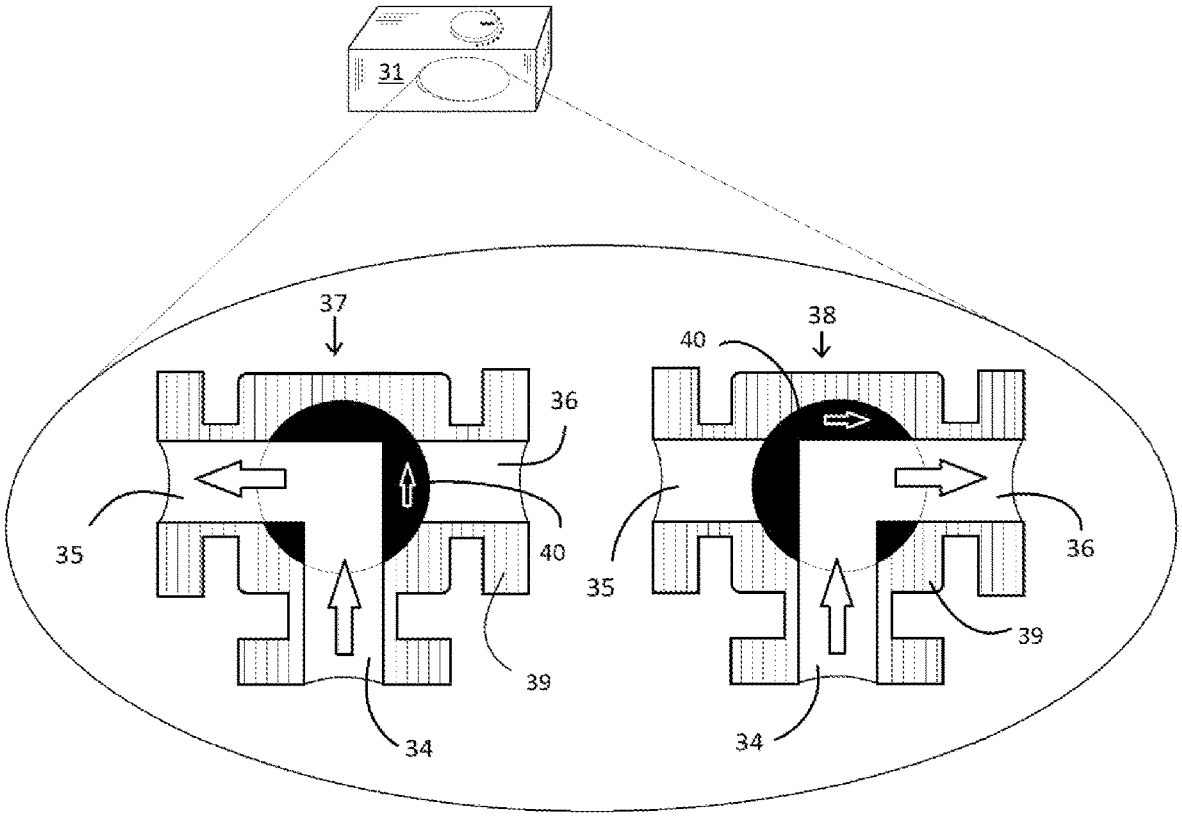
FIG. 6 is a partial and enlarged longitudinal cross-sectional view of the control assembly of FIG. 5 showing the T-valve with 90 L-Port, according to an embodiment of the invention.
Figure 7:
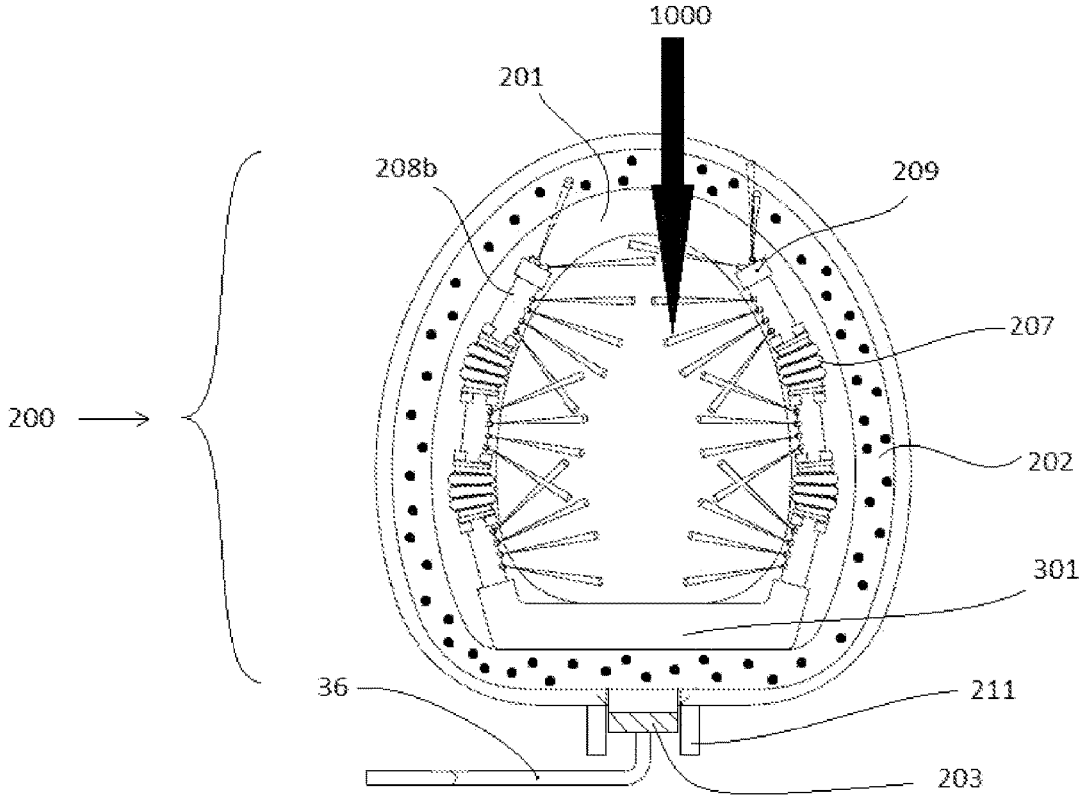
FIG. 7 is an underside view of the toilet seat assembly used for cleaning system according to an embodiment of the invention.
Figure 8A:
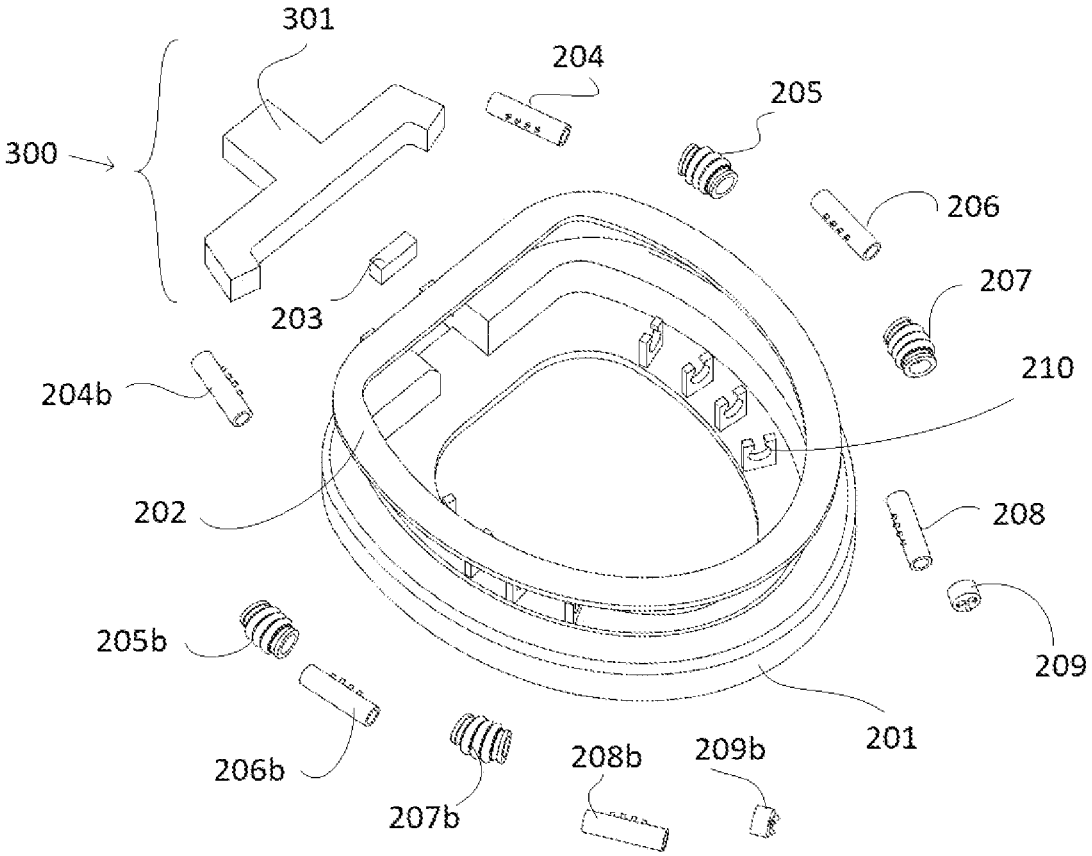
FIG. 8A is an exploded perspective view of FIG. 7 toilet seat assembly used for cleaning system according to an embodiment of the invention.
Figure 8B:
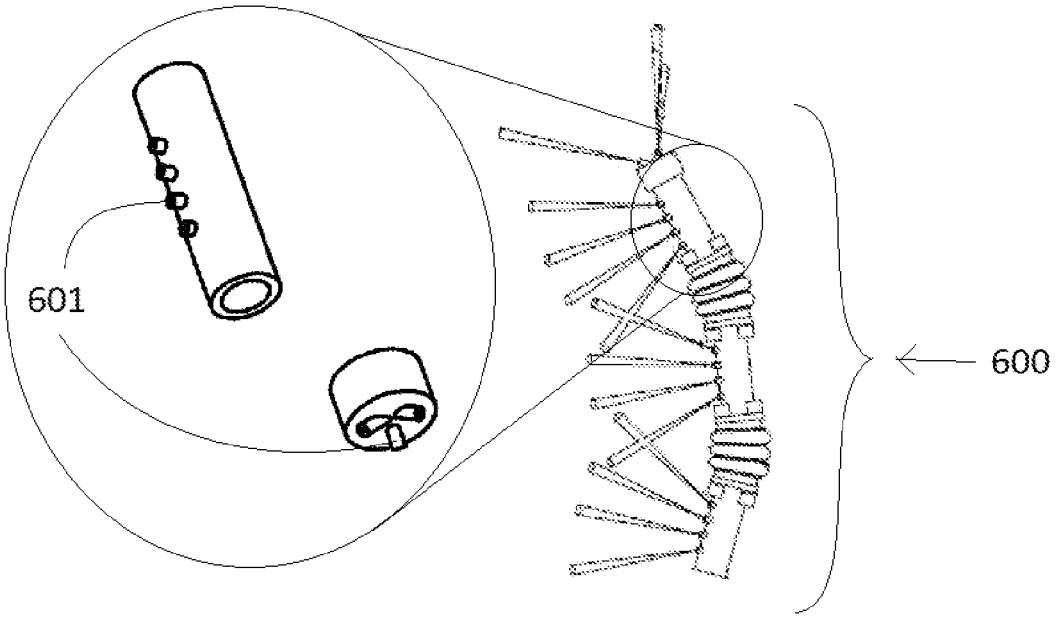
FIG. 8B is an enlarged view of the spray arm assembly 600 and spray nozzle(s) 601.
Figure 9:
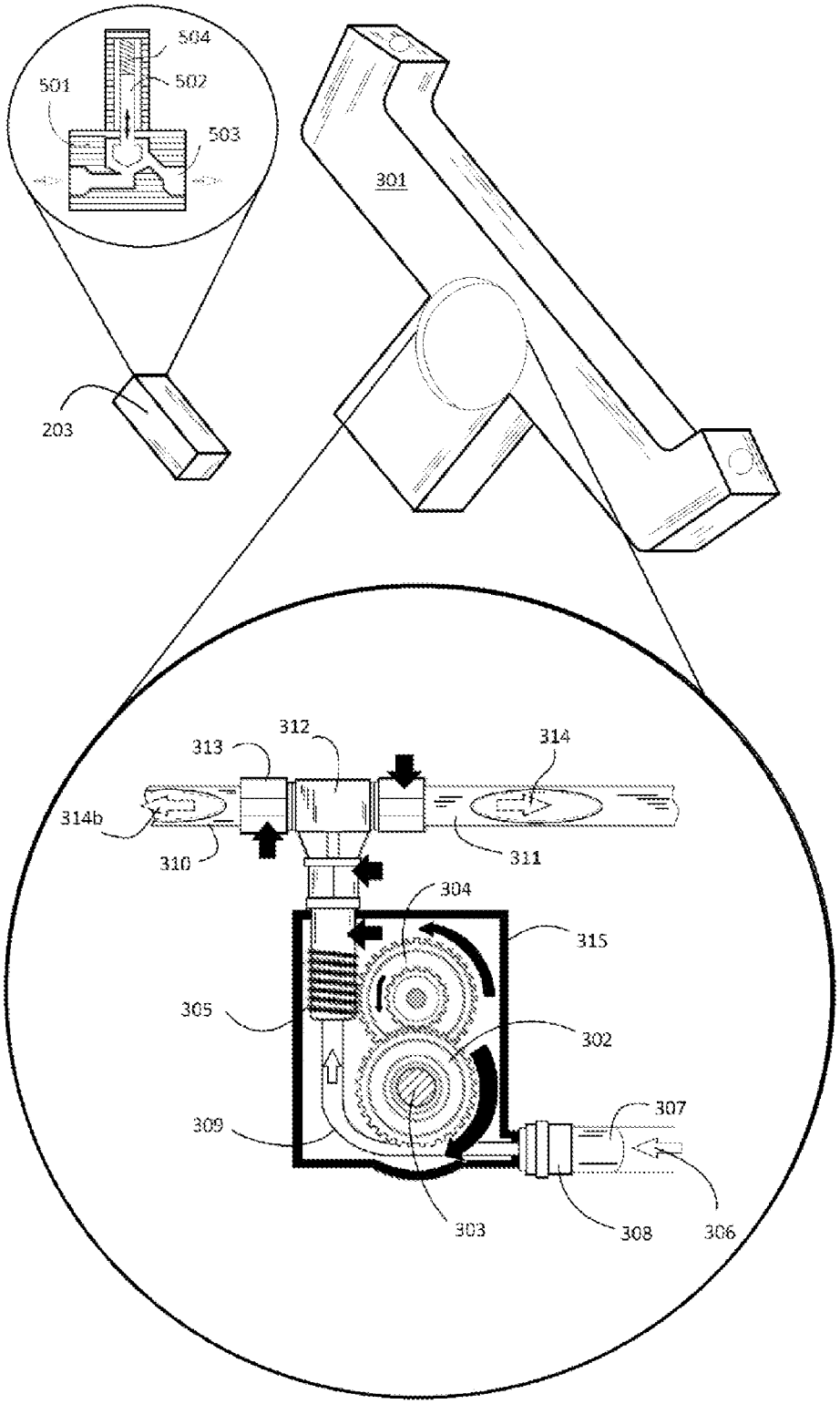
FIG. 9 is a partial and enlarged longitudinal cross-sectional view of the gear box case of FIG. 8 and is a partial and enlarged longitudinal cross-sectional view of the interior of the Lid Open Sensor & Valve of FIG. 8.
Figure 10:
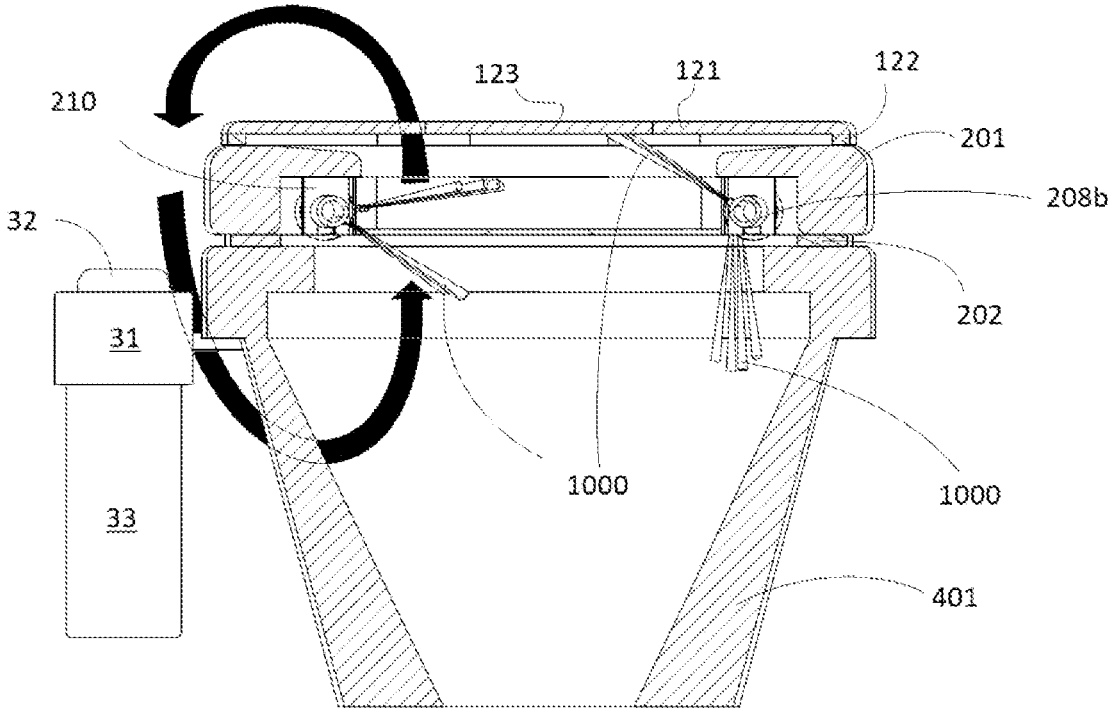
FIG. 10 is a front cross-sectional view of FIG. 3B showing the rotation of the spray arms and jets in an embodiment of the invention.

Referring to FIGS. 1-10, the Machine's design depicted here represents one of many potential configurations. It consists of pressurized liquid from a supply source like a residential water system entering a supply line, piping, or channel (34) and entering a control box (31) which consist of a mechanically powered timer (32) which is driven by torsion spring or similar method. The timer may serve as the one touch operation activator or on off switch and setting control. The timer may count down and may rotate a connected L-Valve or T-Valve (39) from the closed position (38) to the open position (37). The L-Valve or T-valve (39) may contain a 90-degree L-Port or similar mechanism (40). When the L-Valve is in the open position and the time is not activated (37), the liquid may flow from the supply line piping (36) to the Tank (701) via piping (35) allowing the tank to fill and the toilet to operate normally. When the timer (31) is engaged, the T-Valve may be in the closed position (38) thus deflecting liquid material through piping (36) to collect Cleaning Agent from the container (33) and flow to the Seat Assembly (200).

Liquid material is automatically prevented from entering the toilet assembly when conditions dictate, like when the cover assembly (120) is open, via a sensor which may consist of an interlock valve, or magnetic solenoid valve, or other means (203). One option for this would be using a magnet (126) mounted to the toilet seat cover (121), via a sensor mount or trigger (127) so that when the toilet cover (121) was in the closed position, the magnet could be positioned to draw a magnetic damper (502) within housing (501) that may be depressed via a spring (504) out from a water channel or piping portion (503 of piping 36) allowing liquid material to flow through the channel.

If operating conditions are acceptable, then pressurized liquid material section (306 of 1000,) can enter the gear box case (301) via piping or water channel portion (307, 309, of pipping 36) from cover open sensor valve (203) and through a connecter (308) into an impeller gear or gear housing (315) turning an impeller (302) that may be used to drive the motion of the spray jet nozzle(s) via water pressure. The impeller may be fixed around an axle (303) and drive a series of drive-reduction gears (304), worm gears (305), bevel gears in gear box (312). Spray Arm Piping Connection(s) and (313) Spray Arm pipe or tubes (310, 311) while allowing liquid material portion (314, 314*b* of 1000) to pass through into the spray arm assembly(s) (600) which may be made up of one or more spray heads (204, 204*b*, 206, 206*b*, 208, 208*b*) containing on or more spray nozzle(s) (601). The spray arms may be interconnected by one or more flexible bellows (205, 205*b*, 207, 207*b*) to allow the spray arms to contour to the seat assembly. The spray nozzles may move or rotate to deliver high velocity liquid stream (1000) across one or more surfaces. The spray heads may be held in place by Spray Arm retention feature(s) (210) that may attached directly to the inside of the seat (201). Finally, the seat assembly (200) may be lined with a seat gasket or molded fitted edge (122) to prevent liquid material from escaping between the seat 201 and the bowl assembly (400) during cleaning.

The cover assembly (120) may consist of the Lid (121) which may be lined with a Lid Gasket or molded fitted edge (122) to prevent liquid material from escaping between the cover and seat 201 during cleaning. One or more window(s), door(s), or aperture(s) openings (124), fitted with opaque or clear parts of any size or shape may be cut, manufactured, attached or added to a toilet cover, seat tank or a combination/variation thereof (123). The window may be opaque or clear. It may be colored, frosted, textured, smooth, open or a combination thereof. It may have the ability to open via a hinge (128) which when opened and closed may interact with a Magnet/Interlock Trigger or similar (126) which may be attached to a Magnet/Interlock Trigger Mount (127) to prevent or allow the flow of liquid material.

With the cover (121) and seat (201) both sealed by gaskets (122 and 202) then a vacuum may be created in the negative space between the three preventing liquid material from draining during normal flushing conditions. Therefore a vent or valve (125) is needed for liquid resistant vent or slits add to a toilet cover seat bowl or attachment to allow air to pass into the toilet bowl but not permit liquid or so cover materials to enter or exit when the toilet seat and or cover are sealed.

The cover assembly 120, seat assembly 200 and Bowl Assembly 400 may be connected together via a Universal Seat Mounting Brackets & Hinge (402) that may be attached to the bowl (401) by the common method for attaching toilet seat assemblies.

The Tank assembly (700) may consist of a Tank (701) and a Tank cover (702) which are depicted for reference purposes though they are not part of the Machine. Flushing the toilet may be the first step in the cleaning operation followed by activating the timer (32).

The parts of these embodiments are listed and described below.

| Assembly # | Part # | Name |
|---|---|---|
| 120 Lid Assembly | 121 | Cover |
| | 122 | Cover Gasket |
| | 123 | Window |
| | 124 | Window Opening |
| | 125 | Vent |
| | 126 | Magnet / Interlock Trigger |
| | 127 | Magnet / Interlock Trigger Mount |
| | 203 | Lid Open Sensor & Valve |
| | 128 | Lid Hinge |
| 30 Control Assembly | 31 | Control Box |
| | 32 | Timer On off Switch |
| | 33 | Cleaning Agent Holder |
| | 34 | Piping From Supply Line |
| | 35 | Piping to Tank Line |
| | 36 | Piping to CA & Seat Assembly |
| | 37 | 90 L-Port Valve Open to Tank |
| | 38 | 90 L-Port Valve Closed to Seat |
| | 39 | Valve Body |
| | 40 | L-Port Ball & Rotation Arrow |
| 200 Seat Assembly | 201 | Seat |
| | 202 | Seat Gasket / Molding Fitting |
| | 203 | Lid Open Sensor & Valve |
| | 204 | Spray Arm Bottom L |
| | 204b | Spray Arm Bottom R |
| | 205 | Flexible Bellows Bottom L |
| | 205b | Flexible Bellows Bottom R |
| | 206 | Spray Arm Mid L |
| | 206b | Spray Arm Mid R |
| | 207 | Flexible Bellows Top L |
| | 207b | Flexible Bellows Top R |
| | 208 | Spray Arm Top L |
| | 208b | Spray Arm Top R |
| | 209 | Spray Arm Cap L |
| | 209b | Spray Arm Cap R |
| | 210 | Spray Arm Retention Feature |
| | 211 | Seat Hinge & Interlock Solenoid Mount |
| 300 Gear Box Assembly | 301 | Gear Box Case |
| | 302 | Impeller Turbine |

-continued

| Assembly # | Part # | Name |
|---|---|---|
| | 303 | Impeller Axle |
| | 304 | Drive & Reduction Gear(s) |
| | 305 | Worm Gear |
| | 306 | Water From Lid Sensor |
| | 307 | Piping from Lid Sensor |
| | 308 | Lid Sensor Piping Connection |
| | 309 | Water Channel |
| | 310 | Pipe to Spray Jet Assembly L |
| | 311 | Pipe to Spray Jet Assembly R |
| | 312 | Bevel Gears Box |
| | 313 | Spray Arm Piping Connection |
| | 314 | Liquid & Cleaning Agent to Spray Arm(s) |
| | 315 | Impeller Housing |
| 203 Lid Sensor Interlock | 501 | Solenoid Body |
| | 502 | Magnetic Damper |
| | 503 | Water Channel |
| | 504 | Spring |
| 400 Bowl Assembly | 401 | Bowl |
| | 402 | Universal Seat Mounting Brackets & Hinge |
| 700 Tank Assembly | 701 | Tank |
| | 702 | Tank Lid |
| Water | 1000 | High Pressure Water Jett |
| 600 Spray Arm Assembly | 601 | Spray Nozzle(s) |

What is claimed is:

1. A toilet seat and toilet cover assembly for a self-cleaning toilet comprising:

a. toilet seat and toilet cover assembly comprising a toilet seat and a toilet cover and a hinge connection assembly connecting said toilet seat and toilet cover assembly over a toilet bowl, whereby both toilet seat and toilet cover are moveable from an open position to a closed position, and said toilet seat and toilet cover provided with a seal between said toilet seat and toilet cover to provide a seal therebetween when in said closed position, and toilet seat provided with a seal positioned so as to provide a seal between said toilet seat and the toilet bowl when in said closed position, and wherein said hinge connection assembly is adapted to connect said toilet seat and toilet cover assembly over the toilet bowl;

b. a water conduit for the supply of water from a source of pressurized water;

c. a spray assembly mounted on said toilet seat and toilet cover assembly and comprising:

i. a sprayer conduit adapted to accept a supply of pressurized water from said water conduit; and ii. a sprayer assembly connected to said sprayer conduit and incorporated into said toilet seat, said sprayer assembly comprising an array of oscillating sprayers, at least some of said sprayers adapted to direct a spray of pressurized water across an interior bowl surface of the toilet bowl and against both the toilet seat and toilet cover, once said toilet seat and toilet cover assembly are connected over the toilet bowl; and d. at least one control valve to control said supply of water to said sprayer conduit.

2. The toilet seat and toilet cover assembly according to claim 1, wherein the array of oscillating sprayers is hydraulically-driven.

3. The toilet seat and toilet cover assembly according to claim 2, said toilet seat having an interior lateral side, wherein said array of oscillating sprayers is directed from said interior lateral side of said toilet seat.

4. The toilet seat and toilet cover assembly according to claim 2, wherein said toilet seat comprises a housing and said sprayer assembly is disposed within said housing.

5. The toilet seat and toilet cover assembly according to claim 1 wherein said sprayer assembly comprises a mechanical arrangement driven by pressurized water from said sprayer conduit and adapted to change the direction of said spray of pressurized water across said interior bowl surface and against said toilet seat and toilet cover assembly.

6. The toilet seat and toilet cover assembly according to claim 1, wherein said at least one control valve comprises an hydraulically-driven timer assembly.

7. The toilet seat and toilet cover assembly to claim 1 wherein said at least one valve comprises a shut off valve adapted to interrupt said supply of water to said sprayer conduit when said toilet seat or toilet cover are moved to the open position.

8. The toilet seat and toilet cover assembly according to claim 1 wherein at least two spray heads of the array of oscillating sprayers adapted to deliver different spray profiles.

9. The toilet seat and toilet cover assembly according to claim 1 wherein said sprayer assembly additionally comprises a cleaning agent container containing a cleaning agent, and connected to said water conduit so as to inject a cleaning agent into said water conduit.

10. A toilet seat and toilet cover assembly for a self-cleaning toilet comprising:

a. a toilet seat and toilet cover assembly comprising a toilet seat and a toilet cover and a hinge connection assembly adapted to connect said toilet seat and toilet cover assembly over a toilet bowl, whereby both toilet seat and toilet cover are adapted to be moved from an open position to a closed position, and said toilet seat and toilet cover provided with a seal between said toilet seat and toilet cover when in said closed position, and wherein said hinge connection assembly is adapted to connect said toilet seat and toilet cover assembly over the toilet bowl;

b. a water conduit for the supply of water from a source of pressurized water;

c. a spray assembly mounted on said toilet seat and toilet cover assembly and comprising:

i. a sprayer conduit adapted to accept a supply of pressurized water from said water conduit; and ii. a sprayer assembly connected to said sprayer conduit and incorporated into said toilet seat, said sprayer assembly comprising an array of oscillating sprayers, at least some of said sprayers adapted to direct a spray of pressurized water across an interior bowl surface of the toilet bowl and against both the toilet seat and toilet cover, once said toilet seat and toilet cover assembly are connected over the toilet bowl; and d. at least one control valve to control said supply of water to said sprayer conduit; and e. a cleaning agent container connected to said water conduit so as to inject a cleaning agent into said water conduit.

* * * * *